US011673389B2

(12) United States Patent
Koide et al.

(10) Patent No.: US 11,673,389 B2
(45) **Date of Patent: *Jun. 13, 2023**

(54) LIQUID DISCHARGE HEAD

(71) Applicant: Brother Kogyo Kabushiki Kaisha, Nagoya (JP)

(72) Inventors: Shohei Koide, Nagoya (JP); Keita Hirai, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/494,382

(22) Filed: Oct. 5, 2021

(65) Prior Publication Data

US 2022/0024210 A1 Jan. 27, 2022

Related U.S. Application Data

(63) Continuation of application No. 16/819,931, filed on Mar. 16, 2020, now Pat. No. 11,155,087.

(30) Foreign Application Priority Data

Apr. 1, 2019 (JP) ..... JP2019-069629

(51) Int. Cl.
*B41J 2/14* (2006.01)
*B41J 2/175* (2006.01)

(52) U.S. Cl.
CPC ..... *B41J 2/14145* (2013.01); *B41J 2/175* (2013.01); *B41J 2002/14419* (2013.01)

(58) Field of Classification Search
CPC .... B41J 2/14209; B41J 2/175; B41J 2/14145; B41J 2202/11; B41J 2002/14225;
(Continued)

(56) References Cited

U.S. PATENT DOCUMENTS 9,688,076 B2 6/2017 Sugahara et al.
10,549,539 B2 2/2020 Katayama et al.
(Continued)

FOREIGN PATENT DOCUMENTS

JP 2008-290292 A 12/2008
JP 2009-179049 A 8/2009
(Continued)

OTHER PUBLICATIONS

Mar. 31, 2021—U.S. Notice of Allowance—U.S. Appl. No. 16/819,931.
(Continued)

*Primary Examiner* — An H Do
(74) *Attorney, Agent, or Firm* — Banner & Witcoff, Ltd.

(57) ABSTRACT

There is provide a liquid discharge head including: a supply manifold; a feedback manifold; and a plurality of individual flow channels having: a supply portion, a descender portion, and a feedback portion. The supply manifold has a plurality of supply ports, and the feedback manifold has a plurality of feedback ports. At least part of the supply manifold overlaps with the feedback manifold in the second direction. The plurality of pressure chambers have first pressure chambers forming a first pressure chamber array and second pressure chambers forming a second pressure chamber array. The first pressure chamber array is arranged at one side, of the supply manifold, in a third direction and the second pressure chamber array is arranged at the other side, of the supply manifold, in the third direction. The first pressure chamber array and the second pressure chamber array are connected to the supply manifold.

14 Claims, 6 Drawing Sheets

(58) Field of Classification Search
CPC ..... B41J 2002/14306; B41J 2202/12; B41J 2002/14419; B41J 2002/14459
See application file for complete search history.

(56) References Cited

U.S. PATENT DOCUMENTS

| | | | | |
|---|---|---|---|---|
| 10,556,438 | B2 | 2/2020 | Koide | |
| 10,864,727 | B2 | 12/2020 | Koide et al. | |
| 11,155,087 | B2 * | 10/2021 | Koide | B41J 2/14209 |
| 2020/0031124 | A1 | 1/2020 | Kawamura et al. | |
| 2020/0254760 | A1 | 8/2020 | Ikeuchi et al. | |

FOREIGN PATENT DOCUMENTS

| | | | |
|---|---|---|---|
| WO | 2018/056292 | A1 | 3/2018 |
| WO | 2018/181733 | A1 | 10/2018 |
| WO | 2019/022154 | A1 | 1/2019 |
| WO | 2019/066019 | A1 | 4/2019 |

OTHER PUBLICATIONS

Jul. 14, 2021—U.S. Notice of Allowance—U.S. Appl. No. 16/819,931.
Feb. 7, 2023—(JP) Notice of Reasons for Refusal—App 2019-069629.

* cited by examiner

LIQUID DISCHARGE HEAD

CROSS REFERENCE TO RELATED APPLICATION

The present application is a continuation of U.S. patent application Ser. No. 16/819,931 filed Mar. 16, 2020, which claims priority from Japanese Patent Application No. 2019-069629, filed on Apr. 1, 2019, the disclosure of which is incorporated herein by reference in its entirety.

BACKGROUND

Field of the Invention

The present disclosure relates to liquid discharge heads configured to jet a liquid such as an ink or the like onto a medium.

Description of the Related Art

There is known an ink jet recording apparatus having an ink jet recording head and an ink tank. The ink jet recording head and the ink tank are connected by a supply tube and a circulation tube. The ink sent from the ink tank to the ink jet recording head via the supply tube is sent back from the ink jet recording head to the ink tank via the circulation tube. In this manner, by circulating the ink, the ink is prevented from drying. Inside the ink jet recording head, there are provided a supply manifold to supply the ink to a plurality of pressure chambers, and a feedback manifold to retrieve the ink which is not jetted from the nozzles among the ink supplied to the pressure chambers. The supply manifold is in communication with the supply tube, while the feedback manifold is in communication with the circulation tube. Note that in the ink jet recording apparatus as described above, a double-layer structure is adopted to arrange a the supply manifold and the feedback manifold to overlap with each other in an up-down direction.

In this context, in the ink jet recording apparatus as described above, in order to supply a sufficient quantity of ink, it is necessary to secure an ink flow quantity or rate flowing in the supply manifold. For this purpose, it is desired to suppress the resistance (flow channel resistance) of the entire flow channels including the supply manifold, the feedback manifold, and a plurality of individual flow channels passing through the pressure chambers from the supply manifold to the feedback manifold.

Further, when the ink is circulated, some air bubbles may come into the supply manifold. If the air bubbles flowing in the supply manifold intrude into the pressure chambers, then the jet characteristic of the ink from the nozzles is liable to vary when the recording head is driven. Therefore, it is desired to adopt a flow channel structure where the air bubbles having come into the supply manifold are less likely to intrude into the pressure chambers.

An object of the present invention is to provide a liquid discharge head having such a flow channel structure that: a liquid is circulated, and a supply manifold and a feedback manifold are arranged to overlap with each other in an up-down direction; it is possible to suppress to a low level the flow channel resistance of all flow channels including the supply manifold, the feedback manifold, and individual flow channels; and air bubbles having come into the supply manifold are less likely to intrude into pressure chambers.

SUMMARY

According to an aspect of the present disclosure, there is provided a liquid discharge head including: a supply manifold extending in a first direction; a feedback manifold extending in the first direction; and a plurality of individual flow channels having a plurality of pressure chambers and a plurality of nozzles. Each of the individual flow channels includes: a supply portion connecting the supply manifold and one of the plurality of pressure chambers; a descender portion extending in a second direction orthogonal to the first direction and connecting the one of the plurality of pressure chambers and one of the plurality of nozzles; and a feedback portion branching from the descender portion and connected to the feedback manifold. The supply manifold has a plurality of supply ports connected to the supply portions of the plurality of individual flow channels, and the feedback manifold has a plurality of feedback ports connected with the feedback portions of the plurality of individual flow channels. At least part of the supply manifold overlaps with the feedback manifold in the second direction. The plurality of pressure chambers have a plurality of first pressure chambers forming a first pressure chamber array aligned in the first direction, and a plurality of second pressure chambers forming a second pressure chamber array aligned in the first direction. The first pressure chamber array is arranged at one side, of the supply manifold, in a third direction orthogonal to the first direction and to the second direction, and the second pressure chamber array is arranged at the other side, of the supply manifold, in the third direction. The plurality of first pressure chambers forming the first pressure chamber array and the plurality of second pressure chambers forming the second pressure chamber array are connected to the supply manifold.

According to the above configuration, at one side of the supply manifold in the first direction, the plurality of first pressure chambers are arranged to form the first pressure chamber array, whereas at the other side of the supply manifold in the first direction, the plurality of second pressure chambers are arranged to form the second pressure chamber array. As compared with a case where the first pressure chambers and the second pressure chambers are all arranged biasedly at one side of the supply manifold in the first direction, it is possible to suppress to a low level the flow channel resistance of all flow channels from the supply manifold, through the individual flow channels, to the feedback manifold. Further, as a liquid is supplied from the supply manifold to the first pressure chambers and the second pressure chambers, accordingly a flow occurs slightly with the liquid flowing in the supply manifold to head for the supply ports from the supply manifold. If the first pressure chambers and the second pressure chambers are all arranged biasedly at one side of the supply manifold in the first direction, then the liquid flowing in the supply manifold has a larger component or share of the liquid flow toward the one side in the first direction, at which the supply ports are arranged. Thereby, air bubbles flowing through the liquid are liable to be drawn or pulled to the one side in the first direction at which the supply ports are arranged. To deal with this problem, in the above configuration, the first pressure chambers and the second pressure chambers are arranged on both sides of the supply manifold in the first direction, respectively. By virtue of this, because it is possible to disperse the orientations of the flow occurring slightly from the supply manifold toward the supply ports, as compared with a case where the supply ports are arranged biasedly at one side of the supply manifold in the first direction, it is possible to reduce the possibility of drawing or pulling the air bubbles flowing through the liquid to the supply ports.

DESCRIPTION OF THE EMBODIMENT

<Overall Configuration of a Printer>

Figure 1:
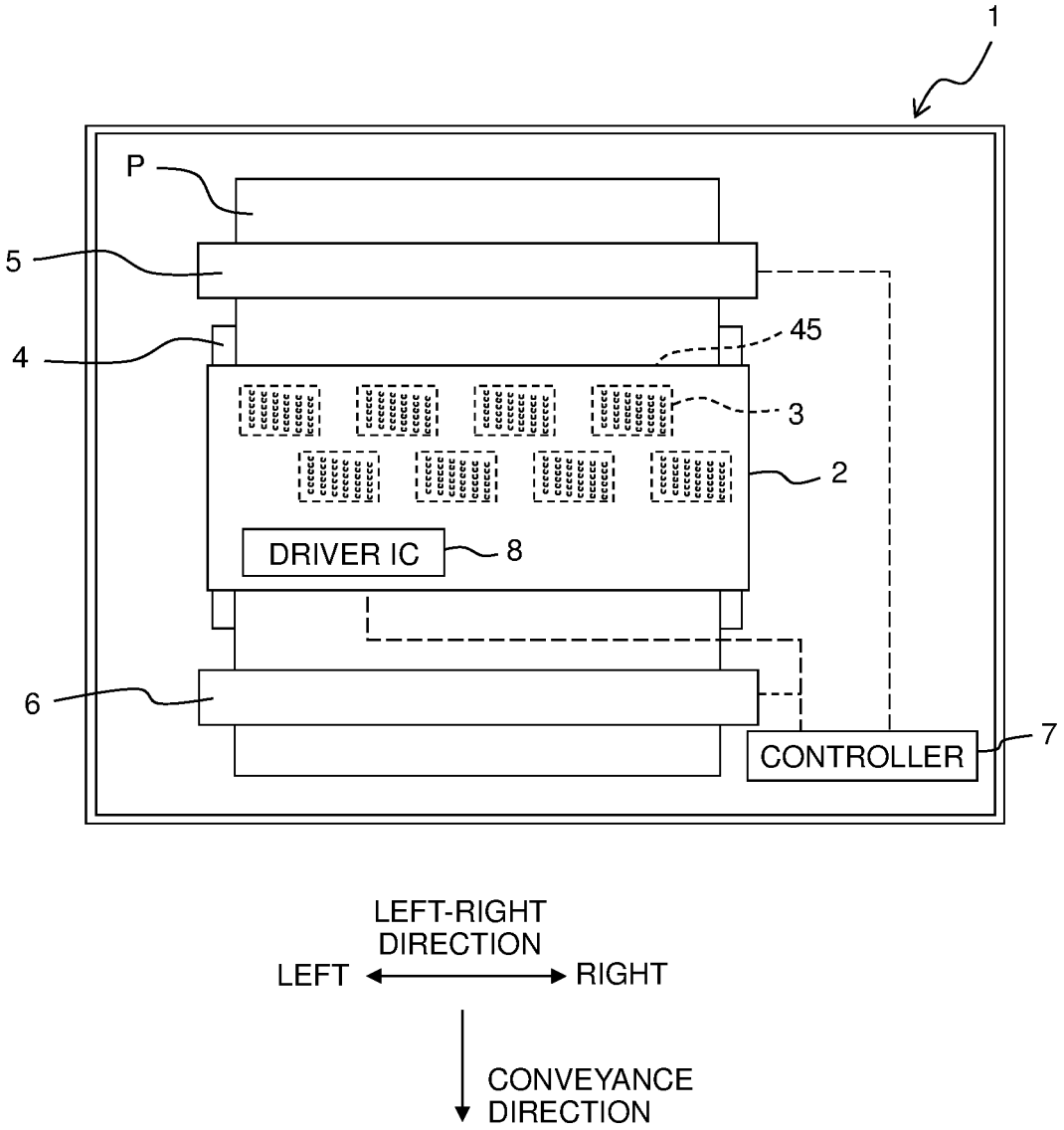
FIG. 1 is a plan view showing an outline of an ink jet printer 1 according to an embodiment of the present disclosure.

As depicted in FIG. 1, an ink jet printer 1 according to an embodiment of the present disclosure primarily includes an ink jet head 2, head units 3, platen 4, conveyance rollers 5 and 6, and a controller 7.

Hereinbelow, as depicted in FIG. 1, the direction of conveying recording paper P is defined as a conveyance direction. A direction orthogonal to the conveyance direction (a width direction of the recording paper P) is defined as a left-right direction. The conveyance direction is an example of the first direction of the present disclosure, while the left-right direction is an example of the third direction of the present disclosure.

The ink jet head 2 is a so-called line-type ink jet head, having the eight head units 3. As depicted in FIG. 1, the eight head units 3 are arranged zigzag in the conveyance direction and in the left-right direction. Each of the head units 3 is provided to jet an ink from a plurality of nozzles 45 formed in the lower surface thereof. A driver IC 8 is provided on the ink jet head 2. As will be described later on, with the controller 7 controlling the driver IC 8, the ink is jetted from the expected nozzles 45.

The platen 4 is arranged to face the lower surface of the ink jet head 2. The platen 4 extends across the entire length of the recording paper P in the left-right direction. The platen 4 supports the recording paper P from below. The conveyance rollers 5 and 6 are arranged at the upstream side and the downstream side of the ink jet head 2 in the conveyance direction, respectively, to convey the recording paper P in the conveyance direction.

In the ink jet printer 1, the controller 7 controls an unsown motor provided for the conveyance rollers 5 and 6 to cause the conveyance rollers 5 and 6 to convey the recording paper P through a predetermined distance in the conveyance direction. Each time the recording paper P is conveyed, the controller 7 causes the ink to be jetted from the plurality of nozzles 45 of the ink jet head 2. By virtue of this, the ink jet printer 1 carries out printing on the recording paper P.

<The Head Units 3>

Figure 2:
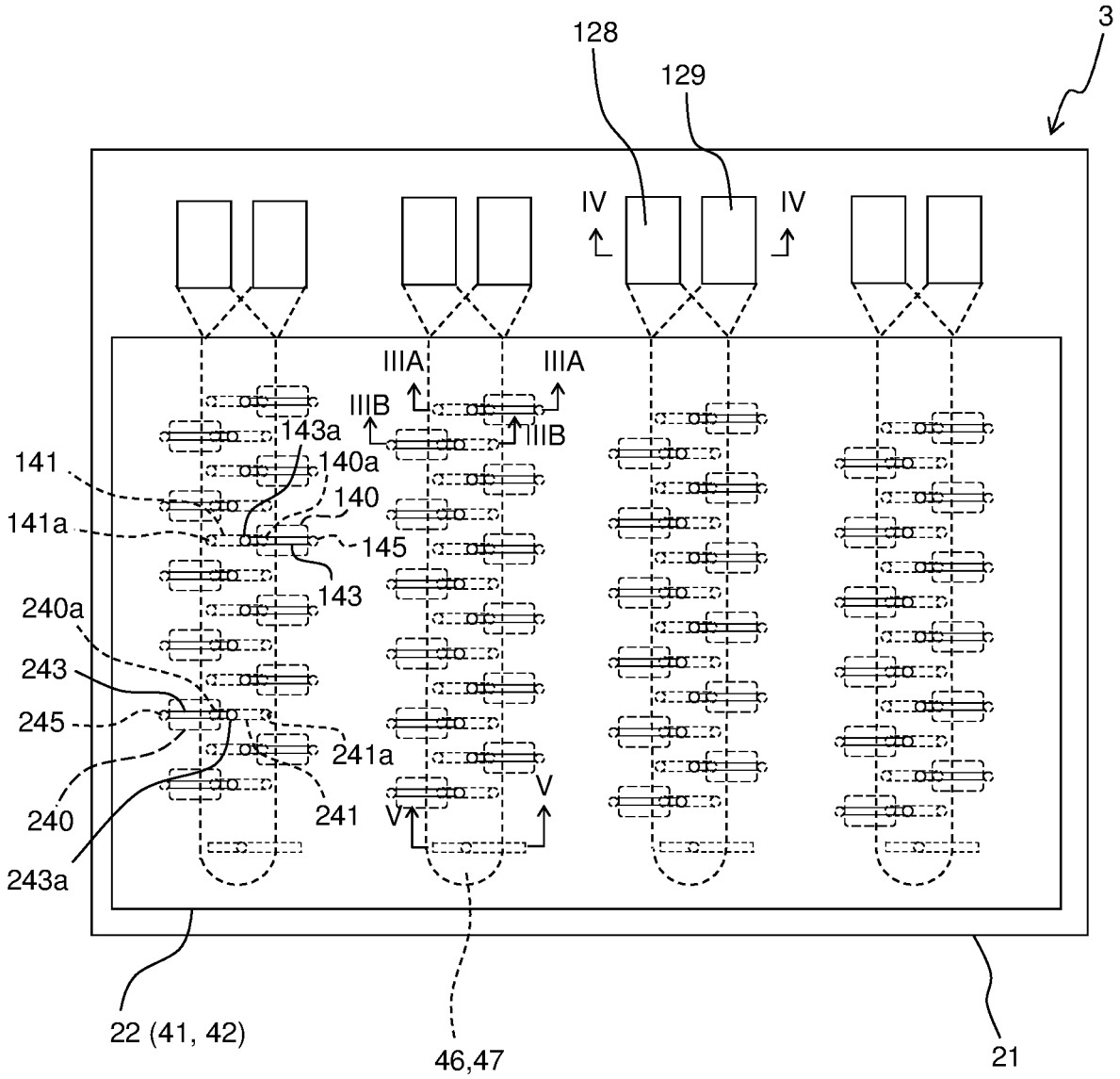
FIG. 2 is a plan view of an ink jet head according to the embodiment.

Next, an explanation will be made on the head units 3. As depicted in FIGS. 2 and 3, each of the head units 3 of the ink jet head 2 includes a flow channel unit 21 where ink flow channels including aftermentioned pressure chambers 140 and 240 are formed, and a piezoelectric actuator 22 for applying a pressure to the ink in the pressure chambers 140 and 240.

<The Flow Channel Unit 21>

Figure 3A:
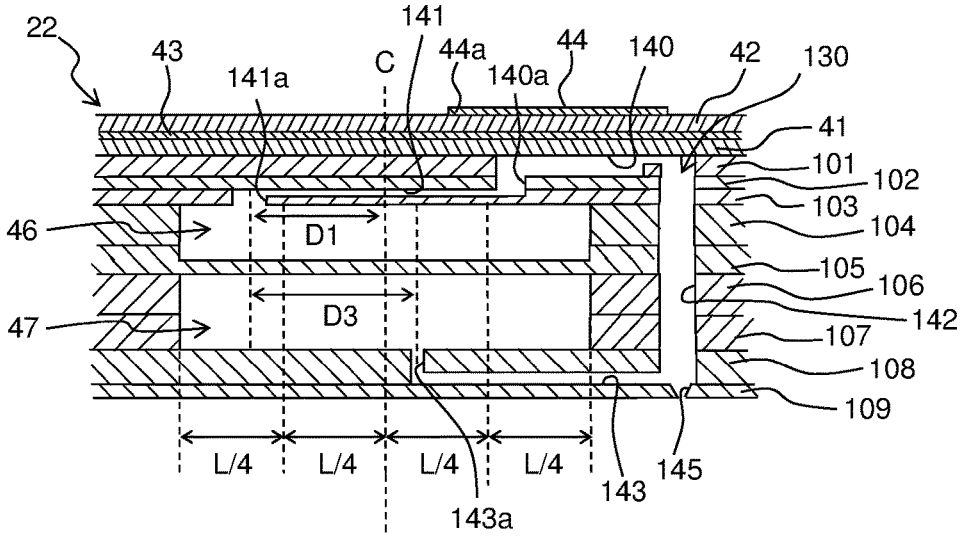
FIGS. 3A and 3B are explanatory views showing a cross section view along the line IIIA-IIIA of FIG. 2 (upper part) and a cross section view along the line IIIB-IIIB of FIG. 2 (lower part)
Figure 3B:
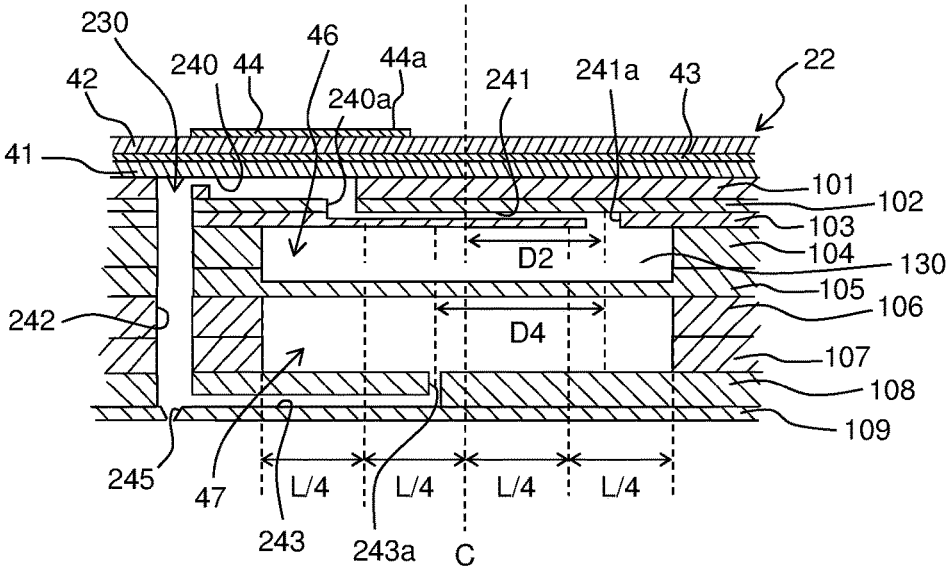
Figure 3B:
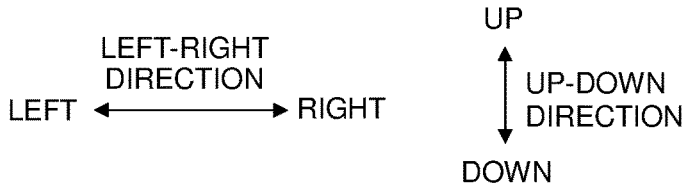

As depicted in FIGS. 3A and 3B, the flow channel unit 21 has nine plates 101 to 109 formed in layers along an up-down direction. As depicted in FIG. 2, the flow channel unit 21 has four supply manifolds 46 and four feedback manifolds 47. The four supply manifolds 46 and the four feedback manifolds 47 are positioned respectively at the same level in the left-right direction, and the four supply manifolds 46 and the four feedback manifolds 47 overlap with each other in the up-down direction. In the flowing explanation, the term "the left side of the supply manifold 46 and the feedback manifold 47" or the like may simply be referred to as "the left side of the supply manifold 46".

At the right side of each supply manifold 46, a pressure chamber array 140L is arranged to extend in the conveyance direction whereas at the left side of each supply manifold 46, a pressure chamber array 240L is arranged to extend in the conveyance direction. The pressure chamber array 140L has a plurality of pressure chambers 140 aligned in a row in the conveyance direction while the pressure chamber array 240L has a plurality of pressure chambers 240 aligned in a row in the conveyance direction. Further, as depicted in FIGS. 3A and 3B, a plurality of individual flow channels 130 and 230 are formed in the flow channel unit 21. Each individual flow channel 130 has a supply portion 141, a descender portion 142, and a feedback portion 143. Each individual flow channel 130 is formed therein with a nozzle 145 and a pressure chamber 140. Each individual flow channel 230 has a supply portion 241, a descender portion 242, and a feedback portion 243. Each individual flow channel 230 is formed therein with a nozzle 245 and a pressure chamber 240. Note that in order to view the figure easily, FIG. 2 shows the feedback portions 143 and 243 with solid lines. The pressure chambers 140 and 240 are examples of the first pressure chambers and the second pressure chambers of the present disclosure, respectively. The pressure chamber arrays 140L and 240L are examples of the first pressure chamber array and the second pressure chamber array of the present disclosure, respectively. Further, the supply portions 141, the descender portions 142, and the feedback portions 143 are examples of "the supply portion in communication with the first pressure chamber", "the descender portion in communication with the first pressure chamber", and "the feedback portion in communication with the first pressure chamber" of the present disclosure, respectively. The supply portions 241, the descender portions 242, and the feedback portions 243 are examples of "the supply portion in communication with the second pressure chamber", "the descender portion in communication with the second pressure chamber", and "the feedback portion in communication with the second pressure chamber" of the present disclosure, respectively.

<The Individual Flow Channels 130>

As depicted in FIG. 3A, the plurality of pressure chambers 140 are formed in the plate 101. Each pressure chamber 140 has an approximately rectangular shape with the left-right direction as its lengthwise direction (see FIG. 2).

As depicted in FIG. 3A, the plurality of supply portions 141 are formed through the plates 102 and 103. Each supply portion 141 is a flow channel linking one pressure chamber 140 to a supply manifold 46. One end of each supply portion 141 is connected to a pressure chamber 140 via an opening 140*a* formed at the left end of the pressure chamber 140. The other end of each supply portion 141 is connected to the supply manifold 46 via a supply port 141*a* (an example of the supply port in communication with the first pressure chamber of the present disclosure). The supply portion 141 is smaller in cross-sectional area than the descender portion 142. The supply portion 141 is connected with the left end of the pressure chamber 140, and extends leftward from the connection part with the pressure chamber 140.

The plurality of descender portions 142 are formed of through holes which are overlapped in the up-down direction and formed in the plates 102 and 108. Each descender portion 142 is a flow channel connecting one pressure chamber 140 to a nozzle 145, and extends downward from the right end of the pressure chamber 140. The nozzle 145 is arranged in the lower end of the descender portion 142.

The plurality of feedback portions 143 are formed through the plate 108. Each feedback portion 143 is a flow channel linking one descender portion 142 to a feedback manifold 47. The feedback portion 143 extends leftward from the connection part with the descender portion 142 formed in the plate 108. Further, the feedback portion 143 is connected to the feedback manifold 47 via a feedback port 143*a* (an example of the feedback port in communication with the first pressure chamber of the present disclosure) formed in the plate 108. Note that the feedback port 143*a* is larger in opening area than the supply port 141*a*.

The plurality of nozzles 145 are formed in the plate 109. Each nozzle 145 is arranged in the lower end of one descender portion 142. One individual flow channel 130 is formed from a nozzle 145, a descender portion 142 connected to the nozzle 145, a feedback portion 143 and a pressure chamber 140 connected to the descender portion 142, and a supply portion 141 connected to the pressure chamber 140.

<The Individual Flow Channels 230>

As depicted in FIG. 3B, the plurality of pressure chambers 240 are formed in the plate 101. Each pressure chamber 240 has an approximately rectangular shape with the left-right direction as its lengthwise direction (see FIG. 2). The pressure chambers 240 have a shape being bilaterally symmetrical with the pressure chambers 140.

As depicted in FIG. 3B, the plurality of supply portions 241 are formed through the plates 102 and 103. Each supply portion 241 is a flow channel linking one pressure chamber 240 to a supply manifold 46. One end of each supply portion 241 is connected to a pressure chamber 240 via an opening 240*a* formed at the right end of the pressure chamber 240. The other end of each supply portion 241 is connected to the supply manifold 46 via a supply port 241*a* (an example of the supply port in communication with the second pressure chamber of the present disclosure). The supply portion 241 is smaller in cross-sectional area than the descender portion 242. The supply portion 241 is connected with the right end of the pressure chamber 240, and extends rightward from the connection part with the pressure chamber 240.

The plurality of descender portions 242 are formed of through holes which are overlapped in the up-down direction and formed in the plates 102 and 108. Each descender portion 242 is a flow channel connecting one pressure chamber 240 to a nozzle 245, and extends downward from the left end of the pressure chamber 240. The nozzle 245 is arranged in the lower end of the descender portion 242.

The plurality of feedback portions 243 are formed through the plate 108. Each feedback portion 243 is a flow channel linking one descender portion 242 to a feedback manifold 47. The feedback portion 243 extends rightward from the connection part with the descender portion 242 formed in the plate 108. Further, the feedback portion 243 is connected to the feedback manifold 47 via a feedback port 243*a* (an example of the feedback port in communication with the second pressure chamber of the present disclosure) formed in the plate 108. Note that the feedback port 243*a* is larger in opening area than the supply port 241*a*.

The plurality of nozzles 245 are formed in the plate 109. Each nozzle 245 is arranged in the lower end of one descender portion 142. One individual flow channel 230 is formed from a nozzle 245, a descender portion 242 connected to the nozzle 245, a feedback portion 243 and a pressure chamber 240 connected to the descender portion 242, and a supply portion 241 connected to the pressure chamber 240.

As depicted in FIGS. 3A and 3B, the supply manifold 46 is formed in the plates 104 and 105. As depicted in FIG. 2, the four supply manifolds 46 extend in the conveyance direction and align at intervals in the left-right direction, respectively. The four supply manifolds 46 correspond to the four pressure chamber arrays 140L and 240L. Each supply manifold 46 is connected with the plurality of pressure chambers 140 forming the corresponding pressure chamber array 140L, via the supply portions 141. Further, each supply manifold 46 is connected with the plurality of pressure chambers 240 forming the corresponding pressure chamber array 240L, via the supply portions 241. An ink feeding port 128 is provided at the upstream end of each supply manifold 46 in the conveyance direction. Then, the ink retained in the undepicted ink tank is fed from the ink feeding port 128 to the supply manifold 46. By virtue of this, in each supply manifold 46, the ink flows from the upstream side toward the downstream side in the conveyance direction, such that the ink passes through each supply portion 141 and is then supplied to each pressure chamber 140, and passes through each supply portion 241 and is then supplied to each pressure chamber 240.

Figure 4:
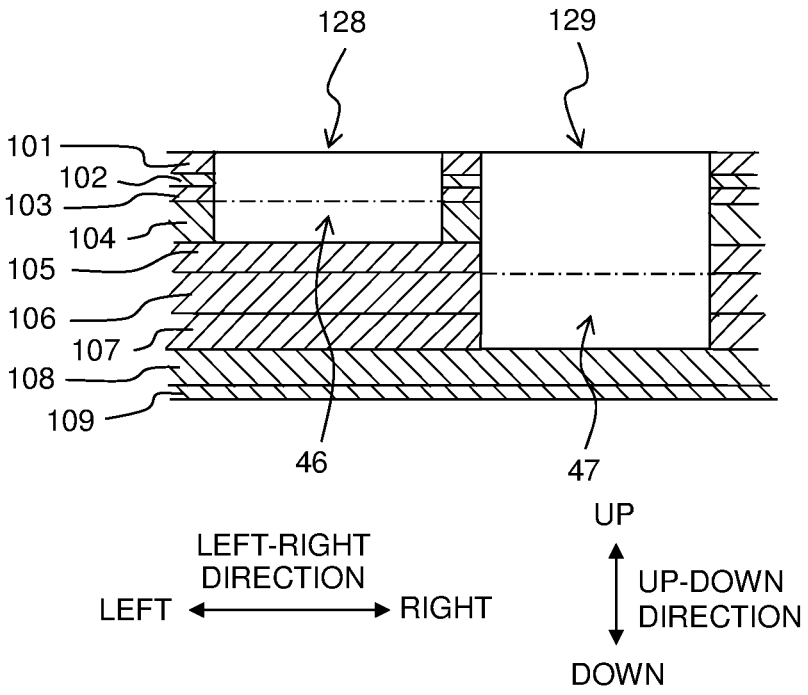
FIG. 4 is a cross section view along the line IV-IV of FIG. 2.

As depicted in FIGS. 3A and 3B, the feedback manifold 47 is formed in the plates 106 and 107. As depicted in FIG. 2, the four feedback manifolds 47 extend in the conveyance direction and align at intervals in the left-right direction, respectively. An ink discharge port 129 is provided in at the upstream end of each feedback manifold 47 in the conveyance direction. The ink discharge ports 129 are connected with the undepicted ink tank. As depicted in FIGS. 3A and 3B and FIG. 4, the feedback manifold 47 is positioned below the supply manifold 46, overlapping with the supply manifold 46 in the up-down direction. Further, the four feedback manifolds 47 correspond to the four pressure chamber arrays 140L and the four pressure chamber arrays 240L. Each feedback manifold 47 is connected with the plurality of pressure chambers 140 forming the corresponding pressure chamber array 140L, via the descender portion 142 and the feedback portion 143. Further, each feedback manifold 47 is connected with the plurality of pressure chambers 240 forming the corresponding pressure chamber array 240L, via the descender portion 242 and the feedback portion 243. The ink not jetted from the nozzles 145 and 245 flows into the feedback manifold 47 from the feedback portions 143 and 243 of the respective individual flow channels 130 and 230; the ink flows on from the downstream side to the upstream side in the conveyance direction; and finally the ink flows out of the ink discharge port 129. The ink flowing out of the ink discharge ports 129 is returned to the undepicted ink tank.

Figure 5:
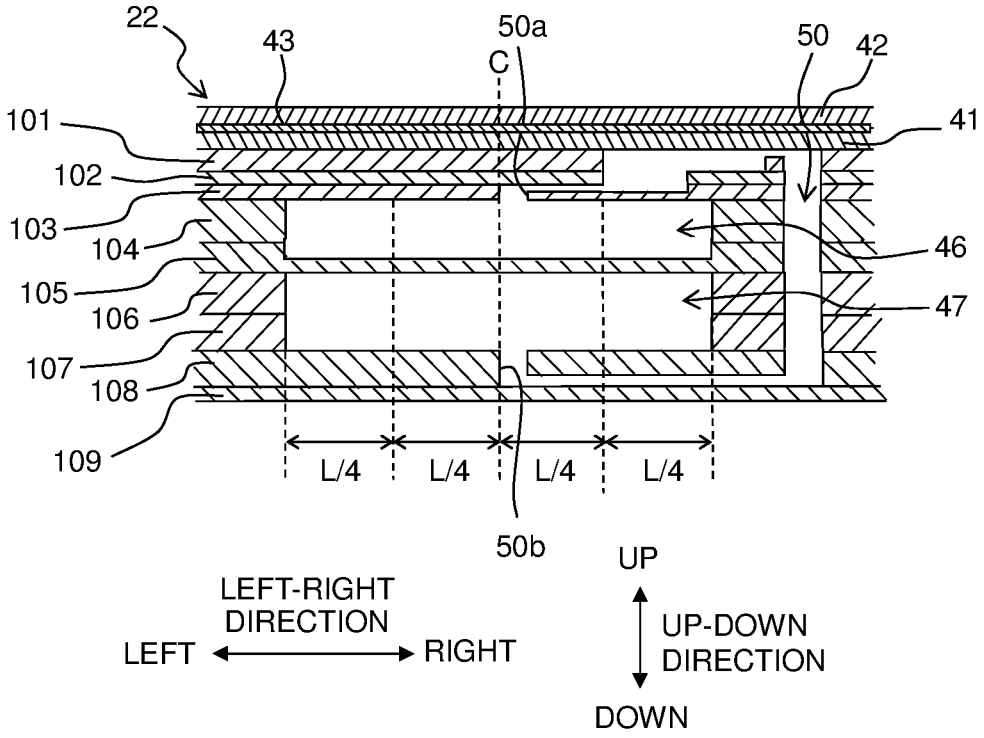
FIG. 5 is a cross section view along the line V-V of FIG. 2.

Further, as depicted in FIG. 2, at the downstream end of the supply manifolds 46 and the feedback manifolds 47 in the conveyance direction, communication flow channels 50 are formed to link the supply manifolds 46 and the feedback manifolds 47. As depicted in FIG. 5, except for the aspect of being not in communication with the nozzle 145, the communication flow channel 50 has the same shape as the individual flow channel 130. Further, a communication port 50*a*, which is a connection port of the communication flow channel 50 and the supply manifold 46, is arranged at almost the center of the supply manifold 46 in the left-right direction. Likewise, a communication port 50*b*, which is a connection port of the communication flow channel 50 and the feedback manifold 47, is arranged at almost the center of the feedback manifold 47 in the left-right direction.

In this embodiment, an undepicted pump is provided in midstream of the flow channel between the ink feeding port 128 and the ink tank, or provided in midstream of the flow channel between the ink discharge port 129 and the ink tank. Due to the ink flow caused by the undepicted pump being driven, the ink circulates between the ink jet head 2 and the undepicted ink tank. Note that, in this embodiment, the pressure on the ink flowing in the supply manifold 46 is rendered larger than the pressure on the ink flowing in the feedback manifold 47.

Further, in the flow channel unit 21, a thinned part 130 is formed in the plate 105 of such a part being thinner than the other part (in terms of the thickness in the up-down direction) as to overlap with the supply manifold 46 and the feedback manifold 47 in the up-down direction. In other words, a partition wall (the thinned part 130) is formed in the plate 105 to separate the supply manifold 46, being thinner than the other part of the plate 105 in thickness (in the length according to the up-down direction).

<Piezoelectric Actuator>

As depicted in FIGS. 3A and 3B, the piezoelectric actuator 22 has two piezoelectric layers 41 and 42, a common electrode 43, and a plurality of individual electrodes 44. The piezoelectric layers 41 and 42 are formed of a piezoelectric material. For example, it is possible to use a piezoelectric material whose primary component is lead zirconate titanate or piezoelectric zirconate titanate (PZT) which is a mixed crystal of lead zirconate and lead titanate. The piezoelectric layer 41 is arranged on the upper surface of the flow channel unit 21, while the piezoelectric layer 42 is arranged on the upper surface of the piezoelectric layer 41. Note that the piezoelectric layer 41 may be formed of an insulating material other than a piezoelectric material.

The common electrode 43 is arranged between the piezoelectric layer 41 and the piezoelectric layer 42 to extend continuously through the entire area of the piezoelectric layers 41 and 42. The common electrode 43 is maintained at the ground potential. The plurality of individual electrodes 44 are provided individually for the plurality of pressure chambers 140 and 240. The individual electrodes 44 each have an approximately rectangular planar shape and are arranged to overlap with a central portion of the corresponding one of the pressure chambers 140 and 240 in the up-down direction. Connection terminals 44*a* of the plurality of individual electrodes 44 are connected to the driver IC 8 (see FIG. 1) via undepicted wire members. Then, the driver IC 8 applies such a potential individually to the plurality of individual electrodes 44 as selectable between the ground potential and a drive potential. Further, corresponding to such an arrangement of the common electrode 43 and the plurality of individual electrodes 44, such active portions are formed between the common electrode 43 and the individual electrodes 44 of the piezoelectric layer 42, respectively, as polarized in a thickness direction.

Hereinafter, an explanation will be made on a method for driving the piezoelectric actuator 22 to jet the ink from the nozzles 145 and 245. In this embodiment, as will be explained below, the ink is jetted by way of so-called "retreat shooting". The following control is carried out by the controller 7 (see FIG. 1) controlling the driver IC 8 to control the potentials of the common electrode 43 and the individual electrodes 44. Here, the explanation will be made on a case where the ink is jetted from a certain nozzle 145. In the piezoelectric actuator 22, in a standby state where the ink is not jetted from the certain nozzle 145, the common electrodes 43 are kept at the same ground potential while all individual electrodes 44 are kept at the drive potential different from the ground potential. On this occasion, the parts of the piezoelectric layers 41 and 42 overlapping with the pressure chamber 140 in the up-down direction deform as a whole to project toward the pressure chamber 140.

In order to jet the ink from the certain nozzle 145, the potential of the individual electrode 44 corresponding to that nozzle 145 is switched to the ground potential. By virtue of this, the parts of the piezoelectric layers 41 and 42 overlapping with the pressure chamber 140 in the up-down direction are recovered from the deformation such that the pressure chamber 140 increases in volume. Thereafter, by switching the potential of the individual electrode 44 back to the drive potential, the parts of the piezoelectric layers 41 and 42 overlapping with the pressure chamber 140 in the up-down direction deform again to project toward the pressure chamber 140. By virtue of this, the pressure of the ink in the pressure chamber 140 increases so as to be jetted from the nozzle 145 in communication with the pressure chamber 140. After the ink is jetted from the nozzle 145, the individual electrode 44 is still kept at the drive potential. Much the same is true with the above explanation on a case where the ink is jetted from a certain nozzle 245.

<Functions and Effects of this Embodiment>

In the ink jet head 2 as explained in the above, air bubbles may be mixed into the ink supplied to the supply manifolds 46 from the ink tank. The ink mixed with the air bubbles flows on the ink flow course in the supply manifolds 46, but some of the air bubbles may flow into the supply portions 141 and 241 from the supply manifolds 46. For example, if the air bubbles flow into the supply portions 141, then they will move to the pressure chambers 140 and the descender portions 142. Therefore, then the ink from the nozzles 145 is liable to vary in jet characteristic. Much the same is true on a case where air bubbles flow into the supply portions 241.

The ink flow is not completely uniform in the supply manifolds 46 of this embodiment. For example, as described above, when the ink is jetted from a certain nozzle 145 or 245, the ink flows from the supply manifold 46 toward the pressure chamber 140 or 240 corresponding to the nozzle 145 or 245. Because of this, a flow occurs slightly with the ink flowing in the supply manifold 46 to head for the supply port 141*a* or 241*a*. Suppose that the supply ports 141*a* and 241*a* are arranged biasedly at one side of the supply manifold 46 in the left-right direction. Then, the ink flowing in the supply manifold 46 has a larger component or share of the ink flow toward the one side in the left-right direction, at which the supply ports 141*a* and 241*a* are arranged. Thereby, the air bubbles flowing through the ink are liable to be drawn to the one side in the left-right direction at which the supply ports 141*a* and 241*a* are arranged. To address this problem, in this embodiment, the pressure chambers 140 and the pressure chambers 240 are arranged respectively on both sides of the supply manifold 46 in the left-right direction. In accordance with this, the supply port 141*a*, which is the connection port of the supply manifold 46 and the supply portion 141 in communication with the pressure chamber 140, and the supply port 241*a*, which is the connection port of the supply manifold 46 and the supply portion 241 in communication with the pressure chamber 240, are arranged respectively on both sides of the supply manifold 46 in the left-right direction. In particular, as depicted in FIGS. 3A and 3B, the supply port 141*a* is arranged at the left side of a center C of the supply manifold 46 in the left-right direction whereas the supply port 241*a* is arranged at the right side of the center C of the supply manifold 46 in the left-right direction. By virtue of this, as compared with the case where the supply ports 141*a* and 241*a* are arranged biasedly at one side of the supply manifold 46 in the left-right direction, the ink flowing in the supply manifold 46 is dispersed in the flow heading in the left-right direction. Therefore, as viewed entirely, no biased ink flow may occur in the left-right direction such as heading for either one side of the supply manifold 46 in the left-right direction. By virtue of this, it is possible to reduce the occurrence of drawing or pulling the air bubbles moving on the ink flow course in the supply manifold 46 toward the supply ports 141*a* and 241*a*, thereby allowing for lessening the possibility of the air bubbles flowing from the supply ports 141*a* and 241*a* into the supply portions 141 and 241. By virtue of this, it is possible to suppress the variation of the jet characteristic of the ink from the nozzles 145 and 245. Note that it is possible to measure the width of the supply manifold 46 in the left-right direction at the endmost part in the left-right direction and, based on that, to define the center C of the supply manifold 46 in the left-right direction. For example, if the lateral surface of the supply manifold 46 in the left-right direction is not of such a cross section shape as depicted in FIGS. 3A and 3B but is of such a curved shape as to expand outward in the left-right direction, then it is possible to measure the width of the supply manifold 46 in the left-right direction at the part positioned outmost in the end portion in the left-right direction (the part expanded outmost in the left-right direction). Note that much the same is true on the width and the center of the feedback manifold 47 in the left-right direction, and on the left-right direction per se.

Further, in this embodiment, because the pressure chambers 140 and the pressure chambers 240 are arranged respectively on both sides of one supply manifold 46 in the left-right direction, as compared with a case where the pressure chambers are arranged biasedly at one side of the supply manifold 46 in the left-right direction, it is possible to suppress to a low level the flow channel resistance of all flow channels: from the supply manifolds 46, through the supply portions 141 and 241, the pressure chambers 140 and 240, the descender portions 142 and 242, and the feedback portions 143 and 243, to the feedback manifolds 47.

In this embodiment, the supply manifolds 46 and the feedback manifolds 47 are arranged to overlap with each other in the up-down direction. By virtue of this, as compared with a case where the supply manifolds 46 and the feedback manifolds 47 are arranged to align in the left-right direction without overlapping in the up-down direction, it is possible to keep a small width of the flow channel unit 21 in the left-right direction so as to make the flow channel unit 21 compact. Note that it is also possible to keep a small width of the flow channel unit 21 in the left-right direction and make the flow channel unit 21 compact by arranging at least some of the supply manifolds 46 to overlap with the feedback manifolds 47 in the up-down direction. In this embodiment, however, the supply manifolds 46 and the feedback manifolds 47 accord to each other in their centers in the left-right direction, and the supply manifolds 46 and the feedback manifolds 47 have the same width in the left-right direction. That is, the supply manifolds 46 and the feedback manifolds 47 overlap completely in the up-down direction. By virtue of this, as compared with a case where only some of the supply manifolds 46 overlap with the feedback manifolds 47 in the up-down direction, it is possible to keep a small width of the flow channel unit 21 in the left-right direction so as to make the flow channel unit 21 compact.

In this embodiment, as depicted in FIGS. 3A and 3B, a distance D1 from the center C of the supply manifold 46 in the left-right direction to the supply port 141*a* is equal to a distance D2 from the center C of the supply manifold 46 in the left-right direction to the supply port 241*a*. Note that in this specification, the expression "distance A is equal to distance B" not only means that the distance A is completely the same as the distance B but also includes cases where the distance A is within the range of 20% of the distance B (or the distance B is within the range of 20% of the distance A). In this embodiment, because the supply ports 141*a* and 241*a* are arranged equally and equidistantly with respect to the center of the supply manifold 46 according to the left-right direction, it is possible to equalize the flow of the ink in the supply manifold 46 in the left-right direction. By virtue of this, it is possible to reduce the possibility of drawing the air bubbles flowing in the ink toward either the supply port 141*a* or the supply port 241*a*. Note that in the definition of the above distance, the position of the supply port 141*a* refers to the central position of the supply port 141*a*. The central position of the supply port 141*a* may adopt the barycentric position of the supply port 141*a*, for example, or can adopt the center of the inscribed circle of the supply port 141*a*. Much the same is true on the supply port 241*a*. Likewise, the positions of the feedback ports 143*a* and 243*a* also refer to the central positions of the feedback ports 143*a* and 243*a* (for example, the barycentric positions, the centers of the inscribed circles, or the like).

Because the viscosity of an ink changes according to the temperature of the ink, in order to suppress the variation of the jet characteristic of the ink from each nozzle, it is desirable to keep a constant temperature of the ink supplied to the pressure chambers 140 and 240. In this embodiment, therefore, the ink adjusted with temperature is supplied to the supply manifolds 46. Nevertheless, the ink flowing from the supply manifolds 46 toward the pressure chambers 140 via the supply ports 141*a* is heated by the piezoelectric actuator 22 covering the pressure chambers 140. Hence, the ink returning from the feedback ports 143*a* to the feedback manifolds 47 via the pressure chambers 140 may have a higher temperature than the ink flowing in the supply manifolds 46. In this case, if a supply port 141*a* is positioned at the same level as the corresponding feedback port 143*a* in the left-right direction, then with the ink having returned from the feedback port 143*a* to the feedback manifold 47, it is possible for the ink warmed in some parts to enter the supply port 141*a*. Because of this, it is possible to give rise to variation of the jet characteristic of the ink from the nozzles 145. Similar phenomena are also liable to occur if a supply port 241*a* is positioned at the same level as the corresponding feedback port 243*a* in the left-right direction. In this embodiment, therefore, as depicted in FIGS. 3A and 3B, the supply port 141*a* and the corresponding feedback port 143*a* are positioned to deviate from each other in the left-right direction, while the supply port 241*a* and the corresponding feedback port 243*a* are positioned to deviate from each other in the left-right direction. By virtue of this, it is possible to suppress the variation of the temperature of the ink from the supply ports 141*a* and 241*a* toward the pressure chambers 140 and 240. Therefore, it is possible to suppress the variation of the jet characteristic of the ink jetted from the nozzles 145 and 245.

Further, in this embodiment, in the supply manifold 46 and the feedback manifold 47 divided equally into four areas in the left-right direction, the supply port 141*a* is arranged in the leftmost area, the feedback port 243*a* is arranged in the second area from the left, the feedback port 143*a* is arranged in the third area from the left, and the supply port 241*a* is arranged in the rightmost area. In this manner, two supply ports 141*a* and 241*a* and two feedback port 143*a* and 243*a* are arranged dispersedly in the four areas of the supply manifold 46 and the feedback manifold 47 equally divided in the left-right direction, respectively. Therefore, it is possible to reduce the partial variation of the temperature of the ink flowing in the supply manifold 46 and the feedback manifold 47. By virtue of this, it is possible to suppress the variation of the temperature of the ink from the supply ports 141*a* and 241*a* toward the pressure chambers 140 and 240. Therefore, it is possible to suppress the variation of the jet characteristic of the ink jetted from the nozzles 145 and 245. Further, in this embodiment, a distance D3 between the supply port 141*a* and the feedback port 143*a* in the left-right direction is equal to a distance D4 between the supply port 241*a* and the feedback port 243*a* in the left-right direction. Therefore, it is possible to further reduce the partial variation of the temperature of the ink flowing in the supply manifold 46 and the feedback manifold 47. By virtue of this, it is possible to suppress the variation of the temperature of the ink from the supply ports 141*a* and 241*a* toward the pressure chambers 140 and 240. Therefore, it is possible to suppress the variation of the jet characteristic of the ink jetted from the nozzles 145 and 245.

In this embodiment, the supply ports 141*a* and the pressure chambers 140 are arranged at the opposite sides of the center C of the supply manifold 46, according to the left-right direction. Likewise, the supply ports 241*a* and the pressure chambers 240 are arranged at the opposite sides of the center C of the supply manifold 46, according to the left-right direction. Along with this, the supply portions 141 extend rightward from the supply ports 141*a* arranged at the left side of the supply manifold 46 in the left-right direction to and beyond the center C of the supply manifold 46 in the left-right direction, whereas the supply portions 241 extend leftward from the supply ports 241*a* arranged at the right side of the supply manifold 46 in the left-right direction to and beyond the center C of the supply manifold 46 in the left-right direction. In other words, the supply portions 141 and the supply portions 241 extend in the left-right direction to overlap partially with each other as viewed from the conveyance direction. In this case, as compared with a case where the supply ports and the pressure chambers are arranged at the same side of the center C of the supply manifold 46 in the left-right direction, it is possible to elongate the supply portions 141 and the supply portions 241. Here, the two plates 101 and 102 are arranged above the supply portions 141 and the supply portions 241. In this context, the active portions of the piezoelectric actuator 22 are arranged on the pressure chambers 140 and 240, and heat due to the driving of the ink jet head 2. The heat also transmits to the ink flowing in the supply portions 141 and the supply portions 241 via the ink inside the pressure chambers 140 and 240. As described earlier on, in this embodiment, because the two plates 101 and 102 are arranged above the supply portions 141 and the supply portions 241, it is possible to remove the heat from the ink flowing in the supply portions 141 and the supply portions 241 via those plates 101 and 102. By virtue of this, it is possible to lower the temperature of the ink flowing into the pressure chambers 140 and 240, thereby allowing for suppression of the heating of the piezoelectric actuator 22 along with the driving of the ink jet head 2. By virtue of this, it is possible to restrain the ink from worsening its jet characteristic due to the heating of the piezoelectric actuator 22.

In this embodiment, each partition wall is formed by the one plate 105 to separate the supply manifold 46 from the feedback manifold 47. As compared with a case where the partition wall is formed by a plurality of plates, it is possible to raise the thermal conduction between the supply manifold 46 and the feedback manifold 47. By virtue of this, it is possible to approximate a uniform temperature of the ink flowing in the supply manifold 46, thereby allowing for suppression of the variation of the jet characteristic of the ink jetted from the nozzles 145 and 245. Note that in this embodiment, by making the partition walls of the plate 105 be thinner than the other parts, the thinned part 130 is formed in each partition wall. By virtue of this, it is possible to further raise the thermal conduction between the supply manifold 46 and the feedback manifold 47, thereby allowing for further approximation to a uniform temperature of the ink flowing in the supply manifold 46. If there are a uniform temperature of the ink flowing in the supply manifold 46 and a uniform temperature of the ink flowing in the feedback manifold 47, then it is possible to reduce the variation of the ink temperature inside the pressure chambers 140 and 240. By virtue of this, it is possible to suppress the variation of the jet characteristic for each of the pressure chambers 140 and 240. Further, consider a case of adjusting the temperature of the ink circulating in the supply manifold 46 and the feedback manifold 47 by using a temperature adjusting mechanism such as a heater or the like. In this case, if there are a uniform temperature of the ink flowing in the supply manifold 46 and a uniform temperature of the ink flowing in the feedback manifold 47, then there is a small gradient of temperature between the ink flowing in the supply manifold 46 and the ink flowing in the feedback manifold 47. Therefore, it is possible to raise the precision in adjusting the temperature.

Modified Embodiments

Figure 6A:
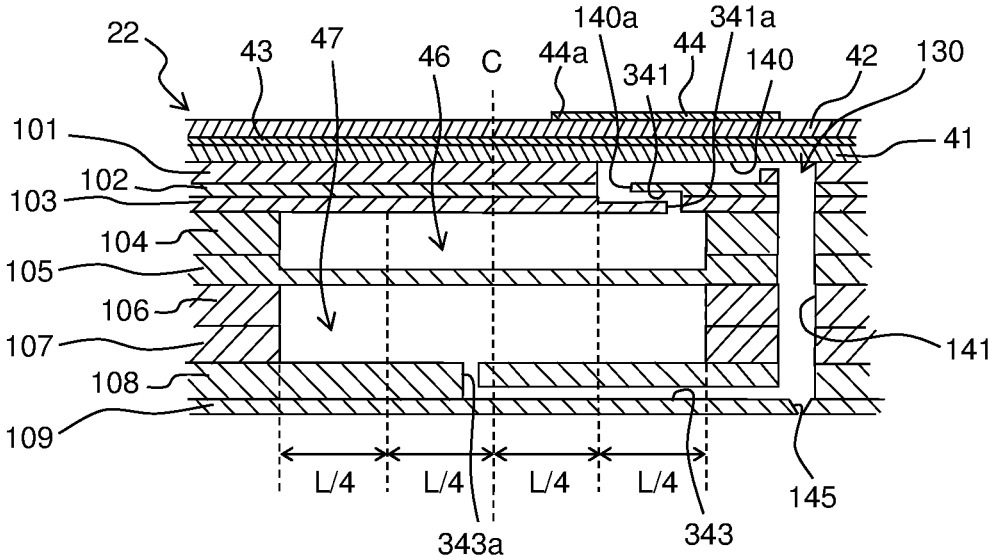
FIGS. 6A and 6B show an ink jet head according to a modified embodiment, corresponding to FIGS. 3A and 3B.
Figure 6B:
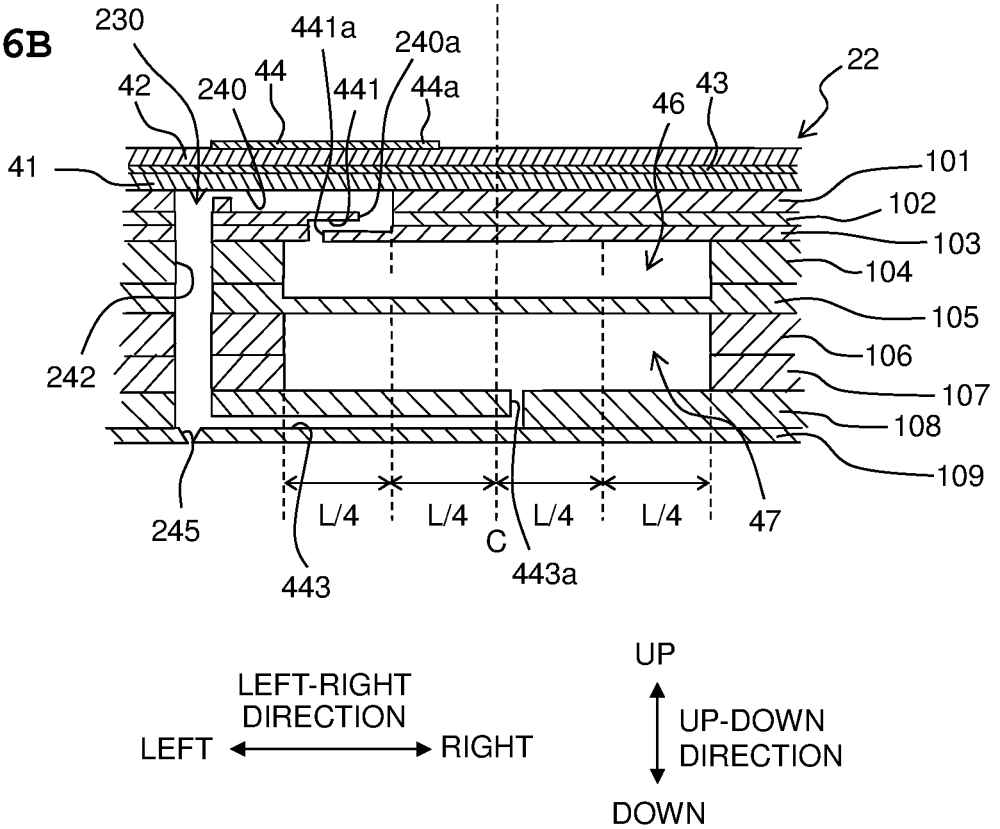

In the above embodiment, the supply ports 141*a* and 241*a* and the descender portions 142 and 242 are arranged on the opposite sides to each other with respect to the center C of the supply manifold 46 in the left-right direction. Along with that, the supply portions 141 and 241 extend from one side to the other side of the supply manifold 46 in the left-right direction beyond the center C in the left-right direction. However, the present disclosure is not limited to such an aspect. As depicted in FIGS. 6A and 6B, for example, a supply port 341*a* and the descender portion 142 may be arranged on the same side with respect to the center C of the supply manifold 46 in the left-right direction, while a supply port 441*a* and the descender portion 242 may be arranged on the same side with respect to the center C of the supply manifold 46 in the left-right direction. In particular, as depicted in FIGS. 6A and 6B, it is possible to arrange the supply port 341*a* in the rightmost area and the supply port 441*a* in the leftmost area, of the four equally divided areas of the supply manifold 46 in the left-right direction. As depicted in FIGS. 6A and 6B, the supply manifold 46 is positioned below a supply portion 341 linking the supply port 341*a* and the pressure chamber 140, and the pressure chamber 140 is positioned thereabove. Further, the supply manifold 46 is positioned below a supply portion 441 linking the supply port 441*a* and the pressure chamber 240, and the pressure chamber 240 is positioned thereabove. As depicted in FIGS. 3A and 3B, in this embodiment, the pressure chamber 140 is not arranged above the supply portion 141 but the plates 102 and 103 are arranged there. Likewise, in this embodiment, the pressure chamber 240 is not arranged above the supply portion 241 but the plates 102 and 103 are arranged there. Differently from that, the supply portions 341 and 441 are interposed between the supply manifold 46 and the pressure chambers 140 and 240 in the up-down direction; therefore, as compared to the case of this embodiment where a plate is superimposed above the supply portions 141 and 241, the ink inside the supply portions 341 and 441 is less likely to be deprived of heat. When the ink adjusted to a comparatively high temperature is supplied to the supply manifolds 46, it is possible to restrain the temperature from decreasing in the ink deprived of heat in the supply portions 341 and 441.

Further, as depicted in FIGS. 6A and 6B, feedback ports 343*b* and 443*b* and the descender portion 142 may be arranged on the opposite sides to each other with respect to the center of the feedback manifold 47, in the left-right direction. In particular, as depicted in FIGS. 6A and 6B, it is possible to arrange the feedback port 343*b* in the second area from the left and the feedback port 443*b* in the third area from the left, among the four equally divided areas of the feedback manifold 47 in the left-right direction. In this case, the feedback portions 343 and 443 extend in the left-right direction to overlap partially with each other as viewed from the conveyance direction. In this case, as compared with a case where the feedback ports 343*a* and 443*a* and the descender portions 142 and 242 are arranged at the same side of the center C of the supply manifold 46 in the left-right direction, it is possible to elongate the feedback portions 341 and the feedback portions 441. Then, via the metallic part (the plate 108) above the feedback portions 341 and the feedback portions 441, it is possible to remove the heat of the ink flowing in the feedback portions 341 and the feedback portions 441. By virtue of this, it is possible to lower the ink temperature having increased due to the passage through the pressure chambers 140 and 240, thereby allowing for preventing the ink temperature from increasing when flowing in the feedback manifolds 47.

Figure 7A:
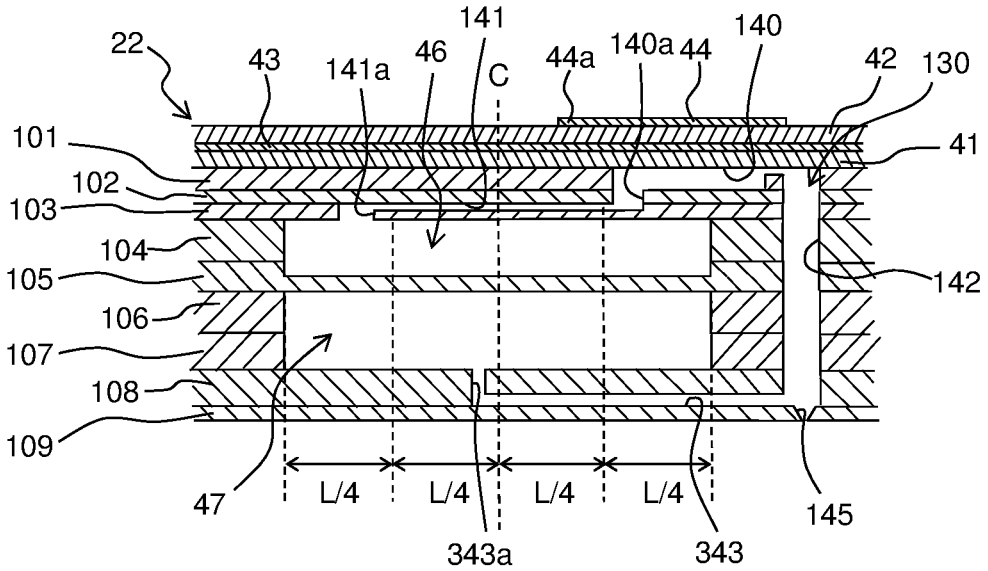
FIGS. 7A and 7B show an ink jet head according to another modified embodiment, corresponding to FIGS. 3A and 3B.
Figure 7B:
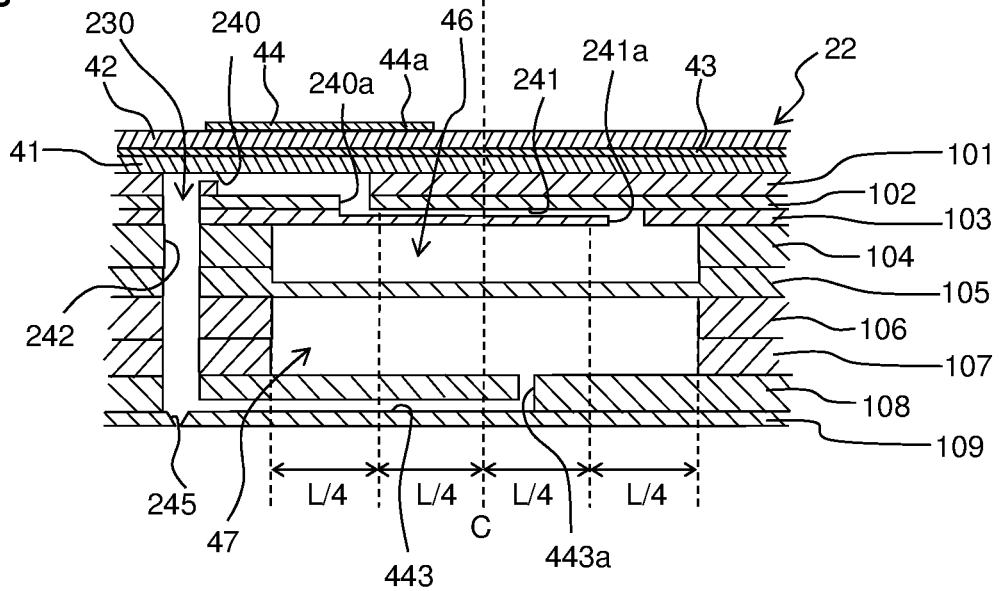
Figure 7B:
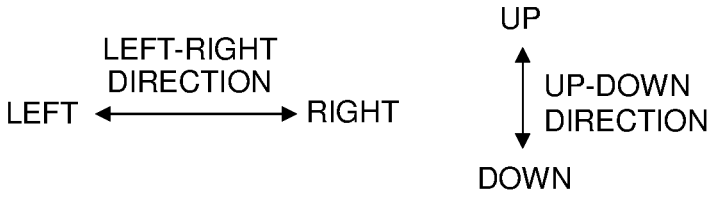

Further, as depicted in FIGS. 7A and 7B, the supply ports 141*a* and 241*a* and the descender portions 142 and 242 may be arranged on the opposite sides to each other with respect C to the center of the supply manifold 46, in the left-right direction. At the same time, the feedback ports 343*b* and 443*b* and the descender portion 142 may also be arranged on the opposite sides to each other with respect C to the center of the feedback manifold 47, in the left-right direction. In this case, too, because the two plates 101 and 102 are arranged above the supply portions 141 and the supply portions 241, it is possible to remove the heat from the ink flowing in the supply portions 141 and the supply portions 241 via those plates 101 and 102. By virtue of this, it is possible to lower the temperature of the ink flowing into the pressure chambers 140 and 240, thereby allowing for suppression of the heating of the piezoelectric actuator 22 along with the driving of the ink jet head 2. Further, via the metallic part (the plate 108) above the feedback portions 341 and the feedback portions 441, it is possible to remove the heat of the ink flowing in the feedback portions 341 and the feedback portions 441. By virtue of this, it is possible to lower the ink temperature having increased due to the passage through the pressure chambers 140 and 240, thereby allowing for preventing the ink temperature from increasing when flowing in the feedback manifolds 47.

The embodiment and the modified embodiments explained above are merely exemplifications in each and every aspect, and therefore may be changed appropriately. For example, it is possible to set up the number, arrangement, shape, pitch and the like for the pressure chambers 140 and 240 in an arbitrary manner and, in accordance with that, to adjust the number, arrangement, shape, pitch and the like for the individual electrodes 44. Further, in the embodiment and the modified embodiments described above, the supply manifolds 46 and the feedback manifolds 47 are arranged to overlap completely in the up-down direction, but the present disclosure is not limited to that. The supply manifolds 46 and the feedback manifolds 47 may be arranged to overlap at least in part in the up-down direction. Further, the piezoelectric layers 41 and 42 are arranged in the upper part of the flow channel unit 21 to cover all pressure chambers 140 and 240. However, the piezoelectric layers 41 and 42 may be divided into a plurality of blocks, for example, for the piezoelectric blocks to cover the plurality of pressure chambers 140 and 240, respectively.

While the ink jet head 2 is a so-called line-type ink jet head, the present disclosure is not limited to that but may also apply to so-called serial-type ink jet heads. Further, the present disclosure is not limited to ink jet heads jetting an ink. The present disclosure may also apply to liquid jet apparatuses used for various purposes other than printing images and the like. For example, it is also possible to apply the present disclosure to liquid jet apparatuses for forming an electrically conductive pattern on a substrate surface by jetting an electrically conductive liquid onto the substrate.

What is claimed is:

1. A liquid discharge head comprising:

a supply manifold extending in a first direction;

a feedback manifold extending in the first direction; and a plurality of individual flow channels having a plurality of pressure chambers and a plurality of nozzles, each of the individual flow channels having: a supply portion connecting the supply manifold and one of the plurality of pressure chambers, a descender portion extending in a second direction orthogonal to the first direction and connecting the one of the plurality of pressure chambers and one of the plurality of nozzles, and a feedback portion branching from the descender portion and connected to the feedback manifold, wherein the supply manifold has a plurality of supply ports connected to the supply portions of the plurality of individual flow channels, and the feedback manifold has a plurality of feedback ports connected with the feedback portions of the plurality of individual flow channels, wherein at least part of the supply manifold overlaps with the feedback manifold in the second direction, wherein the plurality of pressure chambers includes a plurality of first pressure chambers forming a first pressure chamber array aligned in the first direction, and a plurality of second pressure chambers forming a second pressure chamber array aligned in the first direction, wherein the first pressure chamber array is arranged at one side, of the supply manifold, in a third direction orthogonal to the first direction and to the second direction, and the second pressure chamber array is arranged at the other side, of the supply manifold, in the third direction, wherein the plurality of first pressure chambers forming the first pressure chamber array and the plurality of second pressure chambers forming the second pressure chamber array are connected to the supply manifold, wherein in each of the individual flow channels, the supply portion of the individual flow channel connected to a corresponding first pressure chamber extends from the supply port toward the corresponding first pressure chamber, beyond the center of the supply manifold from the one side in the third direction to the other side in the third direction, and wherein the supply portion of the individual flow channel connected to a corresponding second pressure chamber extends from the supply port toward the corresponding second pressure chamber, beyond the center of the feedback manifold from the other side in the third direction to the one side in the third direction.

2. The liquid discharge head according to claim 1, wherein a distance between one of the supply ports connected to one of the first pressure chambers and the center of the supply manifold in the third direction is equal to a distance between one of the supply ports connected to one of the second pressure chambers and the center of the supply manifold in the third direction.

3. The liquid discharge head according to claim 1, wherein in each of the individual flow channels, the position of the supply port is different from the position of the feedback port, in the third direction.

4. The liquid discharge head according to claim 3, wherein two of the supply ports and two of the feedback ports are arranged dispersedly in four equally divided areas of the supply manifold and the feedback manifold, in the third direction, the two of the supply ports including a supply port connected to one of the first pressure chambers and a supply port connected to one of the second pressure chambers, and two of the feedback ports including a feedback port connected to the one of the first pressure chambers and a feedback port connected to the one of the second pressure chambers.

5. The liquid discharge head according to claim 3, wherein a distance, in the third direction, between the supply port and the feedback port connected to the corresponding first pressure chamber is equal to a distance, in the third direction, between the supply port and the feedback port connected to the corresponding second pressure chamber.

6. The liquid discharge head according to claim 3, wherein in each of the individual flow channels, a center of the supply manifold in the third direction coincides with a center of the feedback manifold in the third direction, wherein in each of the individual flow channels, the center of the supply manifold is positioned between the supply port and the feedback port in the third direction, and wherein the center of the supply manifold is positioned between the supply port connected to the corresponding first pressure chamber and the supply port connected to the corresponding second pressure chamber in the third direction.

7. The liquid discharge head according to claim 1, further comprising a plate, wherein a first surface of the plate facing in the second direction defines a part of the supply manifold, and a second surface of the plate on the other side than the first surface in the second direction defines a part of the feedback manifold.

8. A liquid discharge head comprising:

a supply manifold extending in a first direction;

a feedback manifold extending in the first direction; and a plurality of individual flow channels having a plurality of pressure chambers and a plurality of nozzles, each of the individual flow channels having: a supply portion connecting the supply manifold and one of the plurality of pressure chambers, a descender portion extending in a second direction orthogonal to the first direction and connecting the one of the plurality of pressure chambers and one of the plurality of nozzles, and a feedback portion branching from the descender portion and connected to the feedback manifold, wherein the supply manifold has a plurality of supply ports connected to the supply portions of the plurality of individual flow channels, and the feedback manifold has a plurality of feedback ports connected with the feedback portions of the plurality of individual flow channels, wherein at least part of the supply manifold overlaps with the feedback manifold in the second direction, wherein the plurality of pressure chambers includes a plurality of first pressure chambers forming a first pressure chamber array aligned in the first direction, and a plurality of second pressure chambers forming a second pressure chamber array aligned in the first direction, wherein the first pressure chamber array is arranged at one side, of the supply manifold, in a third direction orthogonal to the first direction and to the second direction, and the second pressure chamber array is arranged at the other side, of the supply manifold, in the third direction, wherein the plurality of first pressure chambers forming the first pressure chamber array and the plurality of second pressure chambers forming the second pressure chamber array are connected to the supply manifold, wherein in each of the individual flow channels, the feedback portion of the individual flow channel connected to a corresponding first pressure chamber extends from the descender portion toward the feedback port, beyond the center of the feedback manifold from the one side in the third direction to the other side in the third direction, and wherein the feedback portion of the individual flow channel connected to a corresponding second pressure chamber extends from the descender portion toward the feedback port, beyond the center of the feedback manifold from the other side in the third direction to the one side in the third direction.

9. The liquid discharge head according to claim 8, wherein a distance between one of the supply ports connected to one of the first pressure chambers and the center of the supply manifold in the third direction is equal to a distance between one of the supply ports connected to one of the second pressure chambers and the center of the supply manifold in the third direction.

10. The liquid discharge head according to claim 8, wherein in each of the individual flow channels, the position of the supply port is different from the position of the feedback port, in the third direction.

11. The liquid discharge head according to claim 10, wherein two of the supply ports and two of the feedback ports are arranged dispersedly in four equally divided areas of the supply manifold and the feedback manifold, in the third direction, the two of the supply ports including a supply port connected to one of the first pressure chambers and a supply port connected to one of the second pressure chambers, and two of the feedback ports including a feedback port connected to the one of the first pressure chambers and a feedback port connected to the one of the second pressure chambers.

12. The liquid discharge head according to claim 10, wherein a distance, in the third direction, between the supply port and the feedback port connected to the corresponding first pressure chamber is equal to a distance, in the third direction, between the supply port and the feedback port connected to the corresponding second pressure chamber.

13. The liquid discharge head according to claim 10, wherein in each of the individual flow channels, a center of the supply manifold in the third direction coincides with a center of the feedback manifold in the third direction, wherein in each of the individual flow channels, the center of the supply manifold is positioned between the supply port and the feedback port in the third direction, and wherein the center of the supply manifold is positioned between the supply port connected to the corresponding first pressure chamber and the supply port connected to the corresponding second pressure chamber in the third direction.

14. The liquid discharge head according to claim 8, further comprising a plate, wherein a first surface of the plate facing in the second direction defines a part of the supply manifold, and a second surface of the plate on the other side than the first surface in the second direction defines a part of the feedback manifold.

* * * * *